US011141012B1

(12) United States Patent
Roffey

(10) Patent No.: US 11,141,012 B1
(45) Date of Patent: Oct. 12, 2021

(54) FLOAT WITH BEVERAGE HOLDER COOLER

(71) Applicant: Nigel Roffey, Lakeworth, FL (US)

(72) Inventor: Nigel Roffey, Lakeworth, FL (US)

( * ) Notice: Subject to any disclaimer, the term of this patent is extended or adjusted under 35 U.S.C. 154(b) by 113 days.

(21) Appl. No.: 15/693,671

(22) Filed: Sep. 1, 2017

Related U.S. Application Data

(60) Provisional application No. 62/528,727, filed on Jul. 5, 2017.

(51) Int. Cl.

| | |
|---|---|
| ***A47G 23/02*** | (2006.01) |
| ***B65D 43/22*** | (2006.01) |
| ***B65D 81/38*** | (2006.01) |
| ***F25D 3/06*** | (2006.01) |
| ***F25D 31/00*** | (2006.01) |

(52) U.S. Cl.
CPC ..... *A47G 23/0216* (2013.01); *A47G 23/0241* (2013.01); *B65D 43/22* (2013.01); *B65D 81/3813* (2013.01); *F25D 3/06* (2013.01); *F25D 31/007* (2013.01); *A47G 2023/0283* (2013.01); *A47G 2200/02* (2013.01); *F25D 2303/081* (2013.01); *F25D 2303/0831* (2013.01)

(58) Field of Classification Search
CPC ..... A47G 23/0216; A47G 23/0275; A47G 23/0283; A47G 23/0291
See application file for complete search history.

(56) References Cited

U.S. PATENT DOCUMENTS

| | | | | |
|---|---|---|---|---|
| 1,330,704 | A * | 2/1920 | Heinle | A47J 41/00 220/592.22 |
| 4,461,412 | A * | 7/1984 | Langland | B60R 7/04 224/277 |
| 4,638,593 | A | 1/1987 | Garcia | |
| 4,871,079 | A | 10/1989 | Doucette et al. | |
| 4,927,041 | A | 5/1990 | Hepburn | |
| 6,016,933 | A | 1/2000 | Daily et al. | |
| 6,269,587 | B1 * | 8/2001 | Wallace | A01K 97/06 206/315.11 |
| 6,616,493 | B2 | 9/2003 | Powell et al. | |
| 8,187,047 | B1 * | 5/2012 | Brooks | B63B 35/76 114/345 |
| 8,230,697 | B2 * | 7/2012 | Lavallee | F25D 3/08 62/457.7 |
| 9,149,139 | B1 * | 10/2015 | Rogers | A47G 23/02 |
| 2005/0199770 | A1 * | 9/2005 | Andrews | B60N 3/103 248/311.2 |
| 2008/0078788 | A1 | 4/2008 | Degges et al. | |
| 2013/0265703 | A1 * | 10/2013 | Diebel | H04B 1/3888 361/679.01 |
| 2014/0110413 | A1 | 4/2014 | Kelly et al. | |
| 2015/0233632 | A1 * | 8/2015 | Miller | F25D 3/08 62/62 |
| 2016/0324350 | A1 * | 11/2016 | Rogers | A47G 23/0216 |

* cited by examiner

*Primary Examiner* — Jeffrey R Allen
(74) *Attorney, Agent, or Firm* — Cramer Patent & Design PLLC; Aaron R. Cramer

(57) ABSTRACT

A float with a beverage holder cooler has two (2) interior voids configured for ice storage within the cooler separated by a central wall. The voids are accessed by a common side wall which is securable in a closed position by a strap and a fastener. A beverage container holding aperture is disposed within the top center face of the cooler and extends into the common side wall.

2 Claims, 4 Drawing Sheets

FLOAT WITH BEVERAGE HOLDER COOLER

RELATED APPLICATIONS

The present invention was first described in and claims the benefit of U.S. Provisional Application No. 62/528,727, filed Jul. 5, 2017, the entire disclosures of which are incorporated herein by reference.

FIELD OF THE INVENTION

The present invention relates generally to a floating beverage holder cooler.

BACKGROUND OF THE INVENTION

Insulated beverage or foodstuff coolers are utilized to keep beverages cool while in not convenient locations. An inconvenient location such as a boat, swimming pool, hot tub, or similar area where a body of water is prevalent requires a cooler which is specifically adapted to the location. Various ways to accommodate cooling beverages or foodstuffs while in or near a body of water are known. They include floating beverage coolers which comprise a material which enables the cooler to be buoyant.

Many such devices are not suited to be user friendly. Others are limited to bulkiness which is difficult for transporting the cooler. Still others are not as particularly sized and suited for holding an individual beverage container. Accordingly, there exists a need for floating cooler without the disadvantages as described above. The development of the present invention substantially departs from the conventional solutions and in doing so fulfills this need.

SUMMARY OF THE INVENTION

The inventor has recognized the aforementioned issues and inherent problems and observed that there is a lack in the prior art for a floating beverage holder cooler.

It is therefore an object of the invention to provide a cooler comprising a main body defining an interior and a lid. The main body comprises a main body top, a plurality of sides disposed beneath the main body top, an open bottom in environmental communication with the interior and a sleeve disposed within the main body top. The sleeve has a sleeve sidewall and a sleeve bottom which projects into the main body interior. The lid is configured to removeably secure about the open bottom. There is also a plurality of securement means configured to secure the lid in a closed position. A separate embodiment comes with a tether which is secured to the cooler and attachable to a user. The sleeve is configured to removeably secure a beverage container. The interior can retain a temperature reducing media inside and thereby to facilitate a transfer of heat from the beverage container placed within the sleeve.

A juncture between the open bottom and the lid is waterproof and may comprise a gasket which is co-extensive with an edge of the main body opening. The plurality of securement means may comprise latches. An interior wall of the sleeve further comprises at least one (1) beverage securement means. The securement means may comprise strips of felt.

The main body may comprise a first lumen which is disposed between a body exterior side and a body interior side. The lid may comprise a second lumen which is disposed between a lid exterior side and a lid interior side. The first and second lumen may comprise an insulative material.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
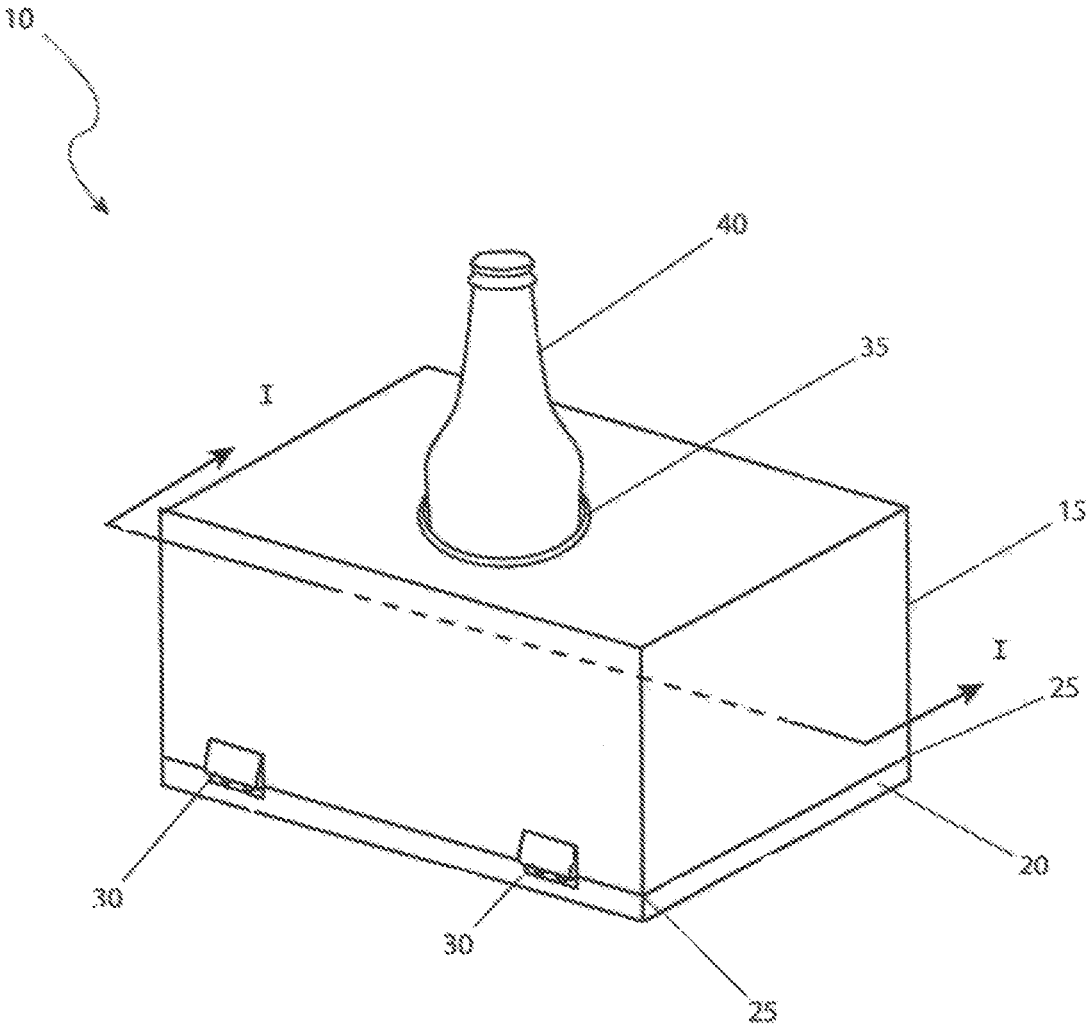
FIG. 1 is a perspective view of the float with cooling beverage holder 10, according to the preferred embodiment of the present invention.

10 float with cooling beverage holder
15 main body
20 removable access cover
25 waterproof juncture
30 securement means
35 circular opening
40 beverage container
45 sidewall structure
50 beverage container sleeve
55 thermal storage well
60 temperature reducing media
65 sleeve side surface
70 sleeve bottom surface
75 felt fabric strips
80 watertight gasket
85 user
90 flotation device
95 body of water
100 tether
105 attachment lug
110 attachment strap
115 wrist
120 ankle
125 fastener
130 first lumen
135 second lumen

DETAILED DESCRIPTION OF THE PREFERRED EMBODIMENT

The best mode for carrying out the invention is presented in terms of its preferred embodiment, herein depicted within FIGS. 1 through 4. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope.

The terms "a" and "an" herein do not denote a limitation of quantity, but rather denote the presence of at least one (1) of the referenced items.

Referring now to FIG. 1, a front view of the float with cooling beverage holder 10, according to the preferred embodiment of the present invention, is disclosed. The float with cooling beverage holder 10 (herein described as the "apparatus") 10, comprises a rectangular parallelepiped shape with the approximate dimensions of ten inches (10 in.) long, five-and-a-half inches (5½ in.) wide, and five-and-a-half inches (5½ in.) deep. The apparatus 10 includes a main body 15 and a removable access cover 20. The main body 15 and the removable access cover 20 are joined together via a waterproof juncture 25 which will be described in greater detail herein below.

The removable access cover 20 is located on the bottom (as shown) or on the side of the main body 15. The placement of the removable access cover 20 on any side surface or bottom surface of the main body 15 should not be interpreted as a limiting factor of the present invention. A series of securement means 30 are provided to physically attach the main body 15 and the removable access cover 20. The securement means 30 may comprise a wide variety of attachment systems including but not limited to: nylon straps, hook-and-loop fastener, snaps, elastic straps, levers, clips (as shown), pins, and the like, with features that render it impervious to the oxidation that chlorinated water can do. The top surface of the apparatus 10 is provided with at least one (1), but possibly up to six (6) or more circular openings 35. The exact quantity, placement, and arrangement of circular openings 35 is not intended to be a limiting factor of the present invention. Each circular opening 35 is intended to hold a beverage container 40, herein depicted as a bottle. The circular opening 35 is intended to hold bottles, cans, glasses, or similar containers that fit within the specified circular openings 35 and the use of any particular type of beverage container 40 is not intended to be a limiting factor of the present invention. The materials of construction used in the apparatus 10 are envisioned to be of a durable plastic outer material with an interstitial inner space filled with insulating material including but not limited to: air, foam, Styrofoam, or similar insulating materials intended to maintain a temperature differential for a sustainable period of time. Further description of the inner construction will be provided herein below. Additionally, due to the insulating properties, the apparatus 10 will float in a body of water during its usage cycle as will also be described in greater detail hereinbelow.

Figure 2:
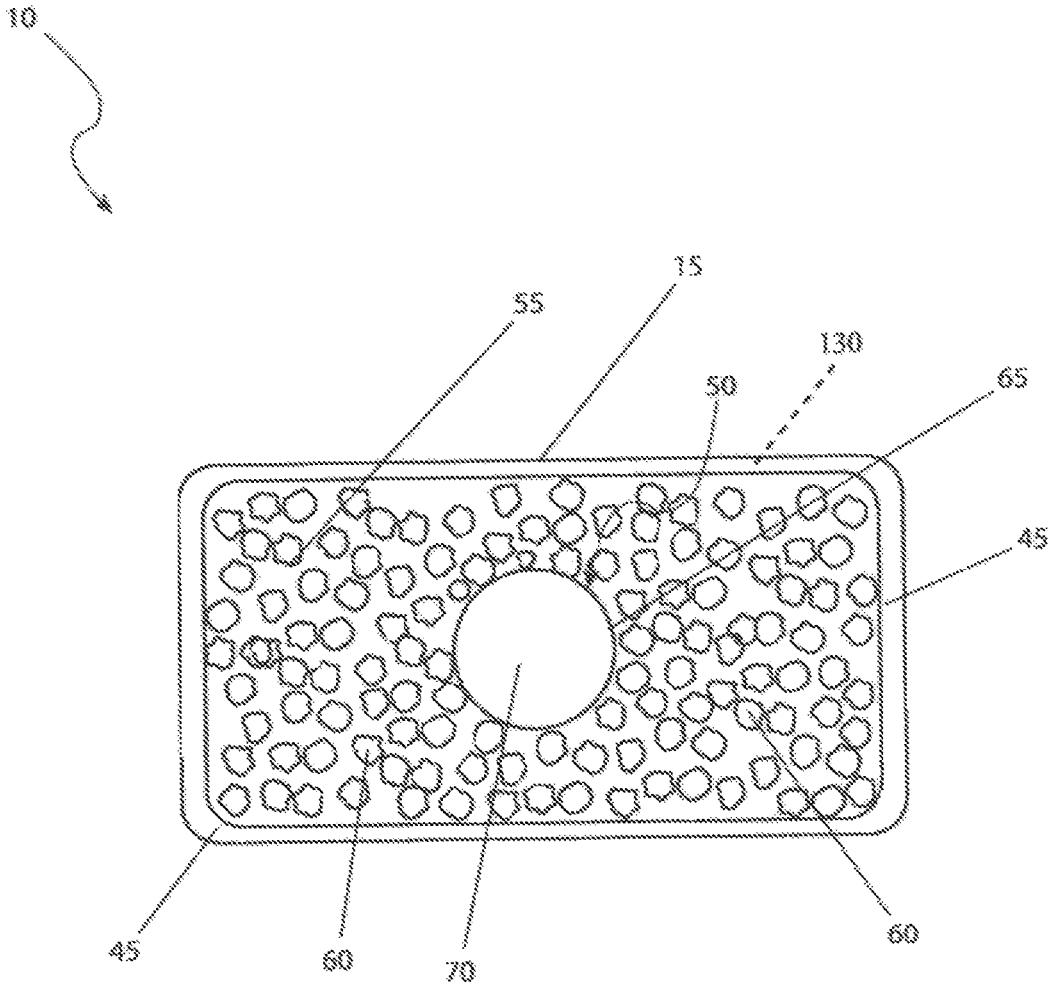
FIG. 2 is a bottom view of the float with cooling beverage holder 10, shown in an open state, according to the preferred embodiment of the present invention.

Referring next to FIG. 2, a bottom view of the apparatus 10, shown in an open state, according to the preferred embodiment of the present invention is depicted. This figure represents the lower opened surface of the main body 15 with the removable access cover 20 (as shown in FIG. 1) removed. The main body 15 is provided with a sidewall structure 45, of appropriate thickness (envisioned to be approximately one-half inch to one inch (½-1 in.) thick depending on insulating properties. A beverage container sleeve 50, envisioned to be made of thin-walled aluminum is placed so as to correspond with the beverage container 40 (as shown in FIG. 1). A thermal storage well 55 is then provided between the sidewall structure 45 and the beverage container sleeve 50 which is filled with a temperature reducing media 60. The temperature reducing media 60 is envisioned to be such materials including but not limited to: ice cubes, ice packs, dry ice, material previously refrigerated or frozen (such as sand, beans, rice, small stones, or the like), or similar material. As such, the cooling properties of the temperature reducing media 60 is directed inward to the sleeve side surface 65 and sleeve bottom surface 70. The thermal properties of the beverage container sleeve 50, being metal, allow for the cooling and low temperature maintenance of the beverage container 40, as shown in FIG. 1.

Figure 3:
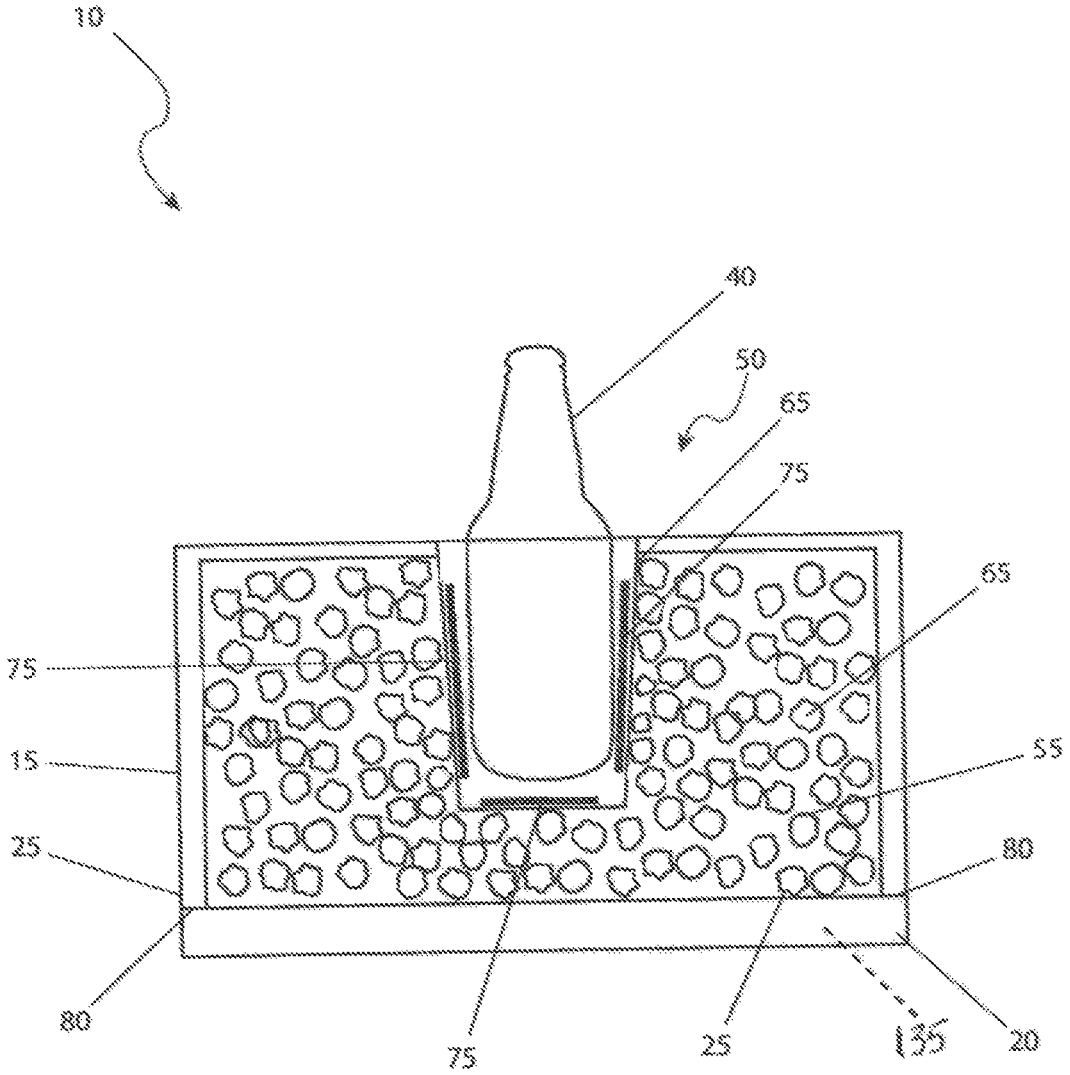
FIG. 3 is a sectional view of the float with cooling beverage holder 10, as seen along a line I-I, as shown in FIG. 1, according to the preferred embodiment of the present invention; and, FIG. 4 is a perspective view of the float with cooling beverage holder 10, shown in a utilized state, according to the preferred embodiment of the present invention.

Referring now to FIG. 3, a sectional view of the apparatus 10, as seen along a line I-I, as shown in FIG. 1, according to the preferred embodiment of the present invention is shown. This figure clearly depicts the beverage container 40 on the interior of the beverage container sleeve 50 below the circular openings 35. A series of felt fabric strips 75 are located along the side interior surface and bottom interior surface of the beverage container sleeve 50. It is envisioned that the felt fabric strips 75 to enable a snug fit of the beverage container 40, prevent accidental dislodgment of the beverage container 40 and prevent direct metal to glass contact (between the beverage container sleeve 50 and a glass version of the beverage container 40) to avoid possible breakage. The temperature reducing media 60, located within the thermal storage well 55 are in physical contact with the side exterior surface and bottom exterior surface of the beverage container 40 to aid in thermal transfer. The temperature reducing media 60 is retained within the thermal storage well 55 by the removable access cover 20 when the apparatus 10 is in an upright position. The removable access cover 20 is made of the same insulating material as the sidewall structure 45. Both the main body 15 and the removable access cover 20 may also comprise a first lumen 130 (FIG. 2) and a second lumen 135 (FIG. 3) both of which may be filled with an insulative material such as but not limited to polystyrene, polyisocyanurate and polyurethane. A watertight gasket 80 is provided between the main body 15 and the removable access cover 20 and the waterproof juncture 25 to aid in retention of melted ice water or other small contaminants from the temperature reducing media 60. It should be noted that additional smaller beverage sleeve inserts can be placed in between the beverage container sleeve 50 and smaller diameter beverage container 40 to increase the effectiveness of thermal transfer.

Figure 4:
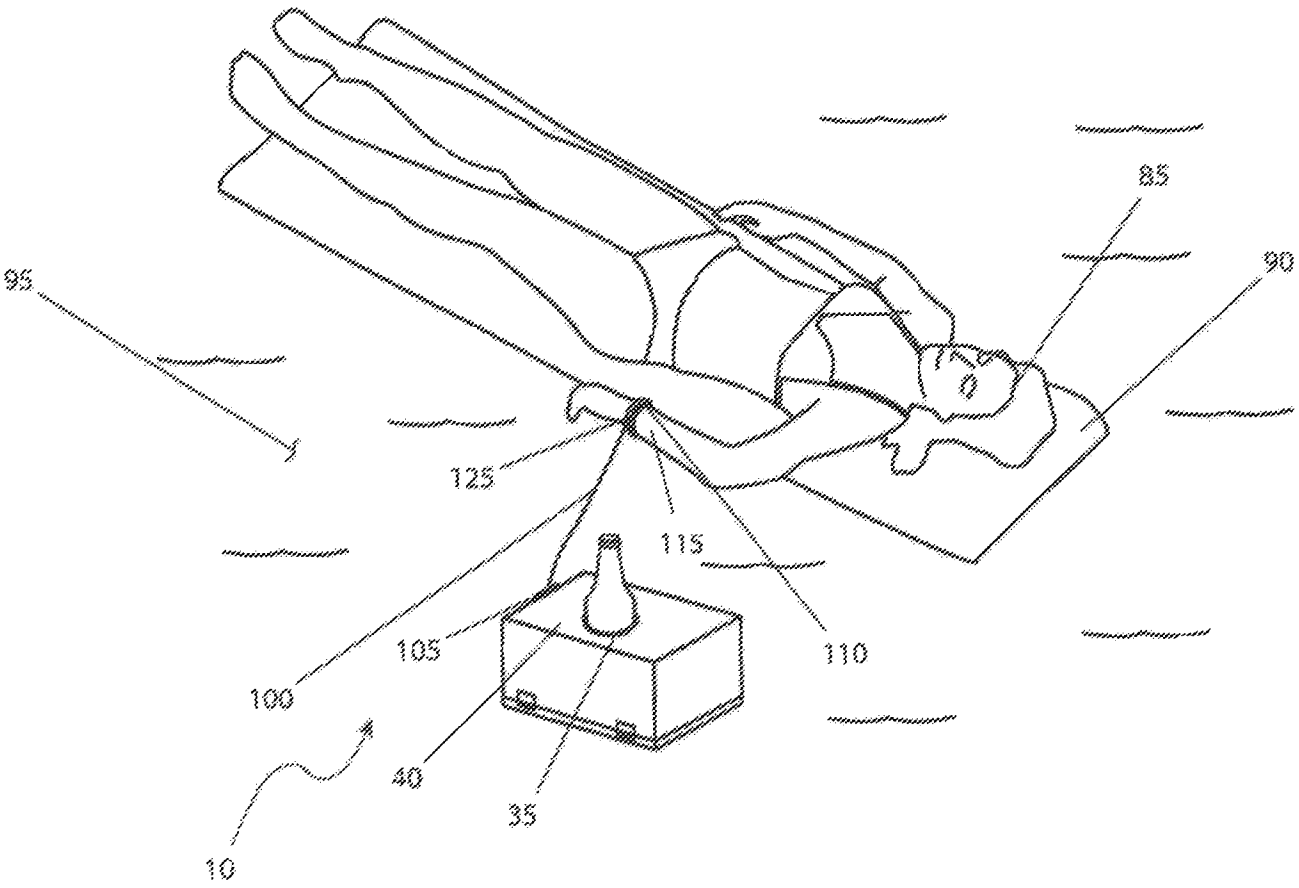

Referring finally to FIG. 4, a perspective view of the apparatus 10, shown in a utilized state, according to the preferred embodiment of the present invention is disclosed. A user 85, who may or may not be assisted into a floating position by a flotation device 90, is floating in a body of water 95. The body of water 95 is envisioned to be, but not limited to, a pool, a hot tub, a lake, a pond, a stream, a river, a creek, an ocean, or the like. The apparatus 10 is positioned near the user 85 so that the beverage container 40 may be removed from the circular openings 35, consumed, and the beverage container 40 returned to the apparatus 10 with the process repeating until the beverage container 40 is empty (completely consumed). In order to prevent the apparatus 10 from floating away from the user 85, a tether 100 is provided. The tether 100, envisioned to be a string, cable, wire, chain, cord, or the like, is attached to an attachment lug 105 molded into the side of the main body 15 and to an attachment strap 110 secured to either the wrist 115 (as shown) or the ankle 120 of the user 85 using hook and loop fastener 125, such as VELCRO®. The tethering is viewed as especially advantageous on bodies of water with moving currents such as rivers, streams, larger lakes, oceans, and the like.

The preferred embodiment of the present invention can be utilized by the common user in a simple and effortless manner with little or no training. It is envisioned that the apparatus 10 would be constructed in general accordance with FIG. 1 through FIG. 3. The apparatus 10 would be made utilizing plastic injection and/or blow molding along with minor mechanical assembly using similar processes and procedures used in the manufacture of conventional personal coolers.

After procurement of the apparatus 10, it would be used in the following manner: The apparatus 10 would be placed on a horizontal work surface in an inverted manner; the removable access cover 20 would be removed by disengagement of the securement means 30; the thermal storage well 55 would be filled with temperature reducing media 60 such as ice or other materials as aforementioned described; the removable access cover 20 would be replaced and secured using the securement means 30; the apparatus 10 would be placed upright; and a beverage container 40 would be placed in the beverage container sleeve 50 within the circular openings 35. At this point in time, the apparatus 10 is ready for utilization.

During utilization of the apparatus 10, it would be placed within a body of water 95 and secured to the user 85 via the tether 100 and the attachment strap 110 to the wrist 115 area or ankle 120 area of the user 85. Whenever the user 85 desires a drink, he or she will retract the apparatus 10 by pulling on the tether 100 until the apparatus 10 is within reach; the 4 removed from the circular openings 35; the beverage consumed; the beverage container 40 returned to the circular openings 35; all continuing until either the beverage container 40 is empty or the user 85 leaves the body of water 95. This usage provides features including but not limited to the following: it keeps beverages cold, it keeps beverages close at hand while in the water; it eliminates having to continuously hold beverages while in the water; it increases safety when using glass containers; it keeps users from having to continuously exit and re-enter the water if a drink is desired; it prevents slips and falls when walking as necessary to get a drink; it increases relaxation, and the like.

At the conclusion of usage, it is envisioned, although not necessary; that any remaining beverage container 40 is removed; any remaining temperature reducing media 60 emptied; the components of the apparatus 10 rinsed; allowed to dry; and stored until a future usage cycle arrives.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. A floating beverage cooler, comprising:

a rectangular main body defining an interior, said rectangular main body interior, comprising:

a rectangular main body top;

a plurality of sides disposed beneath said rectangular main body top;

an open bottom in environmental communication with said rectangular main body interior;

a sleeve disposed within said rectangular main body top and having a sleeve sidewall and a sleeve bottom projecting into said rectangular main body interior;

a lid removably secured about said open bottom; and a plurality of first securement means provided to physically attach said rectangular main body and a removable access cover, said first securement means are a series of clips that are impervious to oxidation from chlorinated water; and a watertight gasket provided between said rectangular main body and said removable access cover and a waterproof juncture adapted to aid in retention of melted ice water or other small contaminants from a temperature reducing media within said rectangular main body;

wherein said sleeve is a removably secured beverage container therein;

wherein said rectangular main body interior is retaining said temperature reducing media therein, thereby facilitating a transfer of heat from said removably secured beverage container placed within said sleeve;

wherein said waterproof juncture further comprises said watertight gasket is coextensive with an edge of a rectangular main body opening;

wherein an interior wall of said sleeve includes a plurality of second securement means;

wherein said second securement means comprises a plurality of strips of felt disposed along said sidewall and said sleeve bottom of said sleeve containing said removably secured beverage container to prevent accidental dislodgment of said removably secured beverage container; and wherein said rectangular main body opening is a circular opening adapted to hold said removably secured beverage container.

2. A floating beverage cooler, comprising:

a rectangular main body defining an interior, comprising:

a rectangular main body top;

a plurality of sides disposed beneath said rectangular main body top;

an open bottom in environmental communication with said rectangular main body interior;

a sleeve disposed within said rectangular main body top and having a sleeve sidewall and a sleeve bottom projecting into a rectangular main body interior end;

a lid removably secured about said open bottom;

a plurality of first securement means provided to physically attach said rectangular main body and a removable access cover, said first securement means are a series of clips that are impervious to oxidation from chlorinated water;

a tether secured to said rectangular main body at a first end and an attachment strap at a second end, said tether is attached to an attachment lug molded into a side of said rectangular main body and to an attachment strap adapted to be secured to a wrist of a user using a hook and loop fastener;

a watertight gasket provided between said rectangular main body and said removable access cover and a waterproof juncture adapted to aid in retention of melted ice water or other small contaminants from a temperature reducing media within said rectangular main body;

wherein said sleeve is a removably secured beverage container therein;

wherein said rectangular main body interior is retaining said temperature reducing media therein;

wherein said waterproof juncture further comprises said watertight gasket is coextensive with an edge of a rectangular main body opening;

wherein an interior wall of said sleeve includes a plurality of second securement means;

wherein said second securement means comprises a plurality of strips of felt disposed along said sidewall and said sleeve bottom of said sleeve containing said removably secured beverage container to prevent accidental dislodgment of said removably secured beverage container; and wherein said rectangular main body opening is a circular opening adapted to hold said removably secured beverage container.

* * * * *